United States Patent [19]

Baehr

[11] Patent Number: 4,969,283

[45] Date of Patent: Nov. 13, 1990

[54] FIREARM EQUIPPED WITH LIVE ROUND INHIBITING MEANS AND METHOD OF MAKING SAME

[75] Inventor: Donald G. Baehr, Albuquerque, N. Mex.

[73] Assignee: The United States of America as represented by the United States Department of Energy, Washington, D.C.

[21] Appl. No.: 420,411

[22] Filed: Oct. 12, 1989

[51] Int. Cl.[5] ..... F41A 17/44

[52] U.S. Cl. ..... 42/70.010; 42/76.010

[58] Field of Search ..... 42/70.01, 76.01

[56] References Cited

U.S. PATENT DOCUMENTS 683,384 9/1901 Cole .
2,476,232 7/1949 Williams .
3,237,335 3/1966 Kerr .
3,686,999 8/1972 Francois .
3,990,169 11/1976 Jennie et al. .
4,242,825 1/1981 deBoer .
4,654,992 4/1987 Lavergne .

*Primary Examiner*—Charles T. Jordan
*Assistant Examiner*—Richard W. Wendtland
*Attorney, Agent, or Firm*—L. E. Carnahan; Roger S. Gaither; William R. Moser

[57] ABSTRACT

A firearm is disclosed having live round inhibiting means mounted in the barrel of the firearm which permits a blank cartridge to be loaded into a firearm and fired while preventing the loading and firing of a live round. The live round inhibiting means comprise shaft means mounted in the barrel of the firearm and which extends a sufficient length into the barrel at a point just beyond the chamber portion of the firearm to engage the bullet portion of a live round to prevent it from properly chambering, while permitting a blank cartridge to be loaded into the firearm and fired without engaging the live round-inhibiting shaft means.

16 Claims, 4 Drawing Sheets

FIREARM EQUIPPED WITH LIVE ROUND INHIBITING MEANS AND METHOD OF MAKING SAME

The invention described herein arose in the course of, or under, Contract No. DE-AC08-83NV10282 between the U.S. Department of Energy and EG&G Energy Measurements, Incorporated.

BACKGROUND OF THE INVENTION

This invention relates to a firearm equipped with a safety device. More particularly, this invention relates to a firearm which has been modified to accept blank cartridges while rejecting live ammunition.

Safety in the storage and use of firearms has become an important issue. A particular safety issue is the prevention of inadvertent discharge of a weapon thought to be unloaded, or loaded with live ammunition when the weapon was thought to be loaded with a blank.

One approach to the safety issue is to provide a lock for the firearm which completely disables the weapon until the lock is removed. For example, Lavergne U.S. Pat. No. 4,654,992 describes a locking device for a firearm which fits into the receiver portion of the firearm through the magazine opening. When a barrel locking cylinder is turned via a key, an arm on the locking device is moved through the ejection port to completely block any loading of a cartridge into the firearm until the lock is removed.

The firearm may also be provided with means that block, or partially block loading of one type of standard cartridge while permitting another standard cartridge to be loaded. Typifying this approach is Jennie et al U.S. Pat. No. 3,990,169, which discloses a shotgun with interchangeable barrels chambered for different length shotgun shells. A lug is provided which extends from the end of the gun barrel chambered for shorter length shells into the receiver section of the gun over the magazine. This lug interferes with the automatic feeding of a longer shell from the magazine into the receiver section of the gun.

Another approach is to alter the firearm so that only a special cartridge may be used. For example, Cole U.S. Pat. No. 683,384 describes an elliptical projectile and a cartridge for same which cooperates with guides in the gun breech to provide proper seating for the cartridge and bullet.

Kerr U.S. Pat. No. 3,237,335 discloses a special firearm and a safety cartridge for use with the special firearm. A series of lugs circumferentially spaced around and protruding inwardly from the wall of the firing chamber of the firearm are received in corresponding slots in the rim of the safety cartridge. When the safety cartridge is inserted into the chamber, the cartridge is rotated until the lugs in the chamber and the slots in the cartridge rim are in registry. In another embodiment, a lug is provided on the rear wall of the firing chamber which matches with a groove formed across the rear end wall of the cartridge casing.

Francois U.S. Pat. No. 3,686,999 describes a firearm comprising a long tube in which are stored a number of missiles. Arranged along one side of the tube are a series of firing devices respectively for each missile. A locking pin in each firing device passes through an opening in the tube and fits into a recess in the respective missile. When the first firing device is activated, its detonator causes the locking pin in the first missile to retract from the recess.

While such safety devices are useful for the purposes intended, it would be desirable to provide a simple modification to a standard firearm, used for training and familiarization with the weapon, whereby only blanks could be fired with the modified firearm and live ammunition could not be fired. In this manner, personnel using the weapon for training purposes could become thoroughly familiar with the weapon, including even simulated firing of the weapon using blanks, without incurring any substantial risk of injury due to inadvertent loading of a live round into the firearm.

SUMMARY OF THE INVENTION

It is, therefore, an object of this invention to provide an improvement in a firearm comprising live round inhibiting means mounted in the barrel of the firearm which permits a blank cartridge to be loaded into a firearm and fired while preventing the loading and firing of a live round.

It is another object of this invention to provide live round inhibiting means for a firearm comprising shaft means mounted in the barrel of the firearm capable of engaging the bullet portion of a live round while permitting a blank cartridge to be loaded into a firearm and fired.

It is yet another object of this invention to provide live round inhibiting means for a firearm comprising shaft means mounted in the barrel of the firearm which extends a sufficient length into the barrel of a firearm at a point just beyond the chamber portion of the firearm to engage the bullet portion of a live round while permitting a blank cartridge, having the same total length as the live round including an extended portion of smaller diameter than the bullet, to be loaded into the firearm and fired without engaging the live round-inhibiting pin.

It is still another object of this invention to provide live round inhibiting means for a firearm comprising shaft means which extends into the barrel of a firearm at a point just beyond the chamber portion of the firearm to engage the bullet portion of a live round while permitting a blank cartridge of equal length to the cartridge portion of the live round to be loaded into the firearm and fired.

It is yet a further object of the invention to provide a method for modifying a standard firearm to provide live round inhibiting means mounted in the barrel of the firearm.

These and other objects of the invention will be apparent from the following description and accompanying drawings.

DETAILED DESCRIPTION OF THE INVENTION

Figure 1:
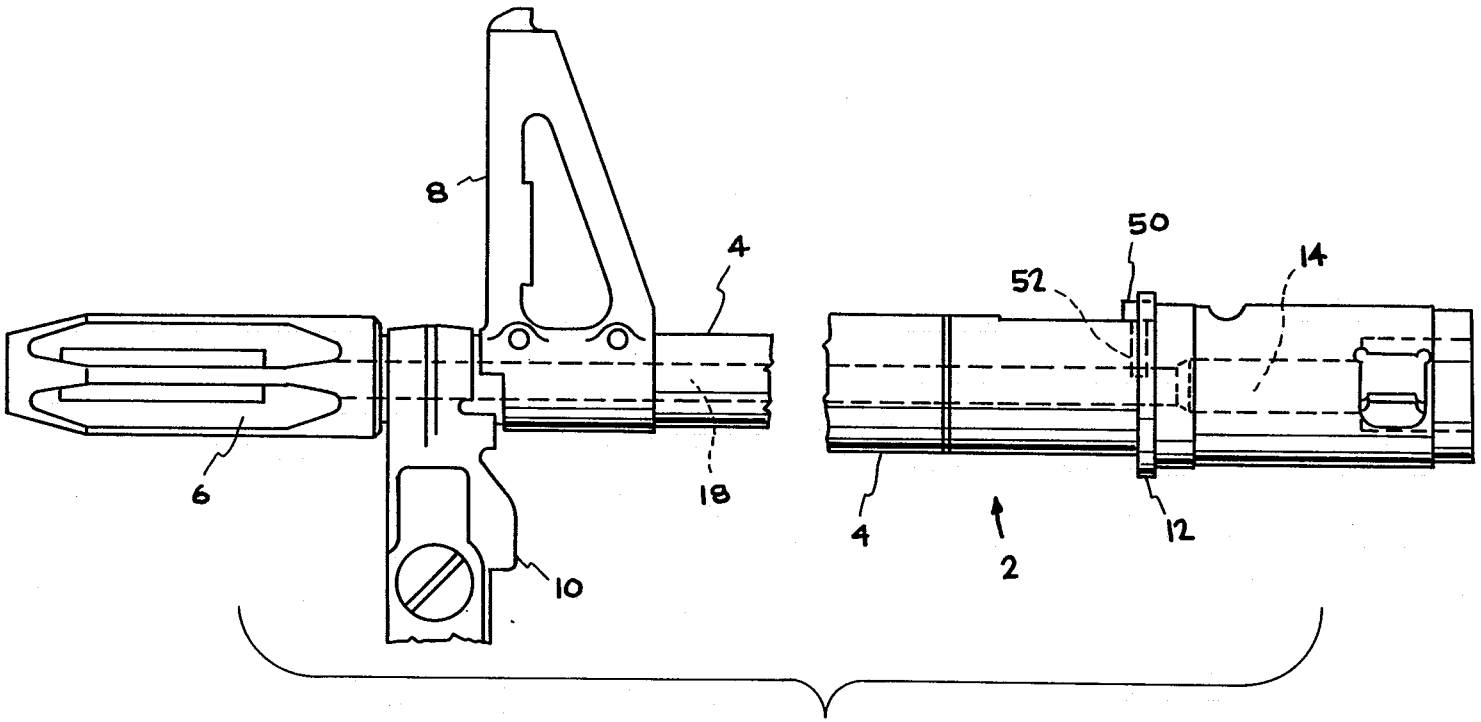
FIG. 1 is a fragmentary side view of a firearm illustrating, in dotted lines, the live round inhibiting means of the invention installed therein.

Referring now in general to FIG. 1, as well as the specific portions of the firearm and live round inhibiting means shown in FIGS. 2–5, portions of a firearm 2, comprising an M60 machine gun, are shown. The illustrated portions of firearm 2 comprise, in general, a barrel 4 with a central bore 18 and a chamber 14. Located at the end of barrel 4, and forming no part of the present invention, are a flash hider 6, a front sight 8, and a portion of the front tripod or support means 10. Also located on barrel 4 is a flange 12 which facilitates mounting of barrel 4 to the remainder of firearm 2. While the illustrated firearm is an M60 machine gun, it will be appreciated that the invention as will be described below is equally applicable to other types of firearms as well, including semiautomatic weapons and single shot weapons, including bolt action weapons. In particular, the illustrated blank cartridge, while described as used in the M60 machine gun, may also be used in the M14 semiautomatic and automatic rifles.

Figure 2:
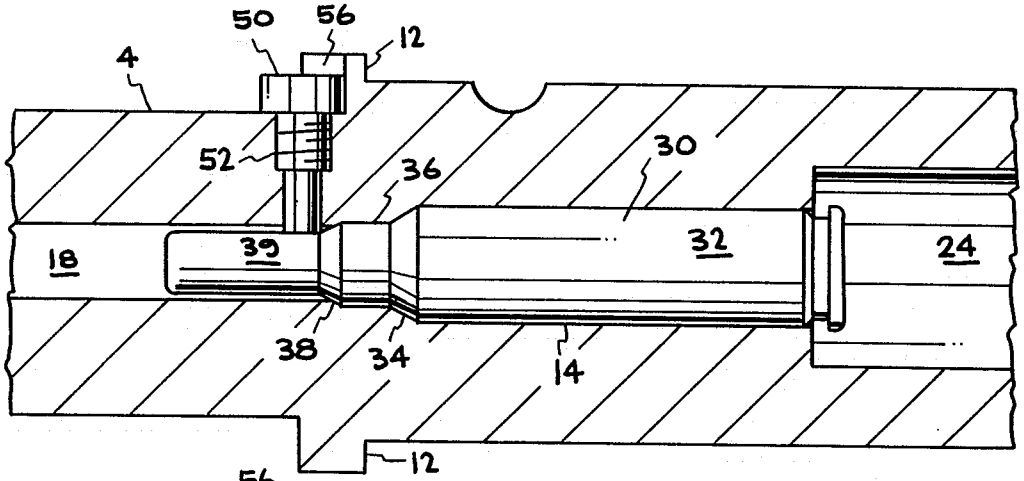
FIG. 2 is a fragmentary side section view of the chamber of a firearm, as well as a portion of the barrel and a portion of the receiver of the firearm, showing a blank round fully loaded into the chamber and ready for firing despite the presence of the live round inhibiting means of the invention therein.
Figure 3:
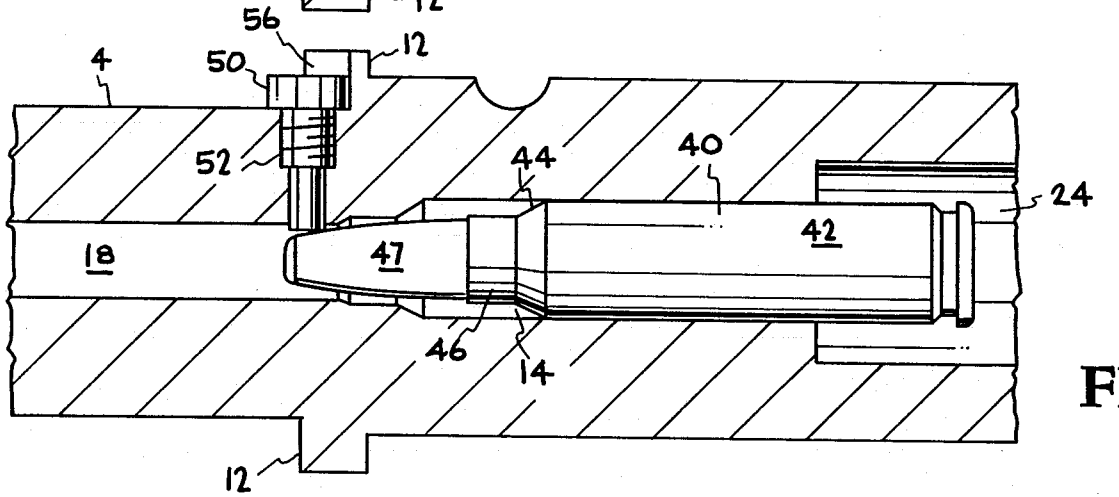
FIG. 3 is a fragmentary side section view of the same portion of the firearm as shown in FIG. 2, but with a live round partially loaded therein with the live round inhibiting means of the invention preventing the live round from being fully loaded into the firearm.
Figure 4:
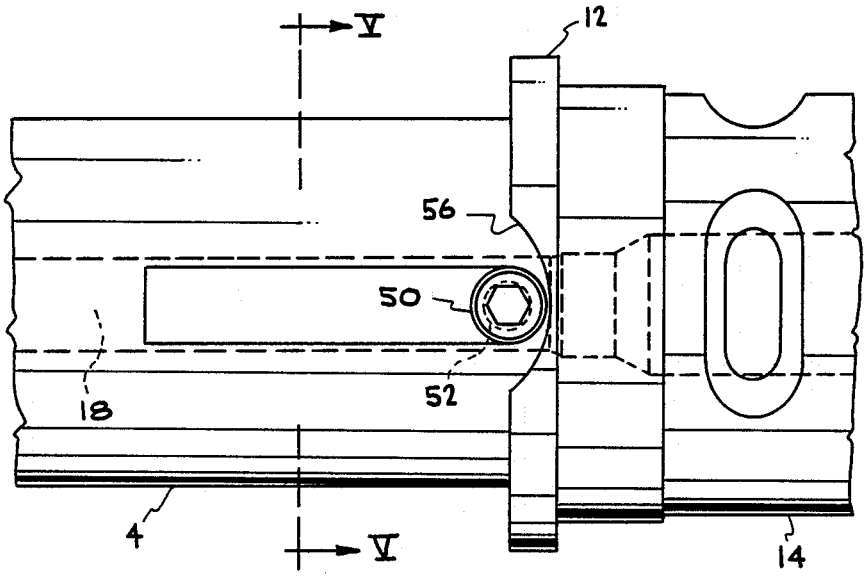
FIG. 4 is a fragmentary top view of the firearm of FIGS. 1–3 showing the exterior portion of the live round inhibiting means of the invention mounted on the top of the barrel of the firearm.
Figure 5:
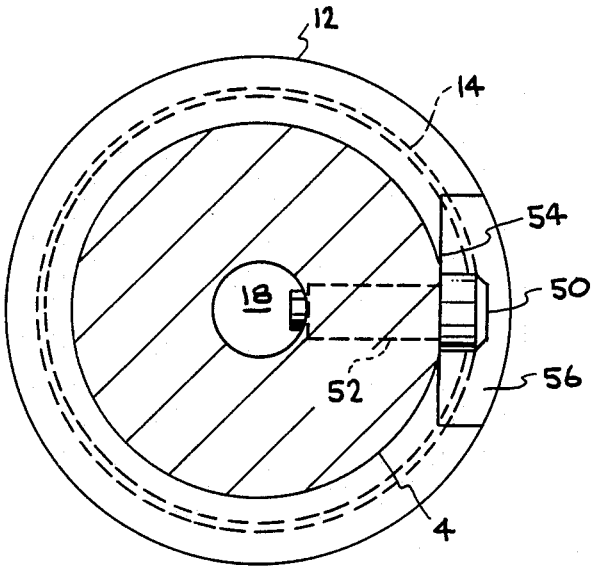
FIG. 5 is an end section view of the firearm structure shown in FIG. 4 taken along lines V—V and showing the live round inhibiting means of the invention protruding into the barrel of the firearm.
Figure 7:
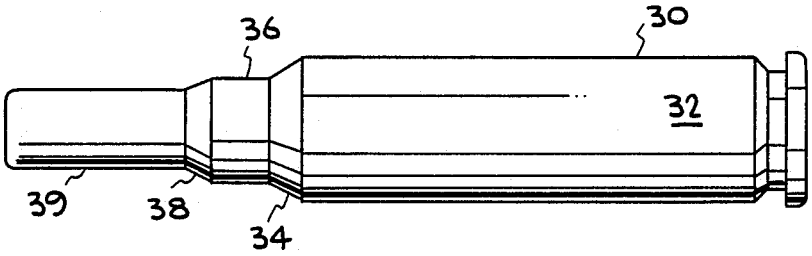
FIG. 7 is a side view of a blank round suitable for insertion into a firearm of the type shown in FIGS. 1–5 even when the live round inhibiting means of the invention is installed therein.

As shown in FIGS. 2 and 7, a blank round of ammunition 30 comprises an enlarged cartridge portion 32, a first tapered portion 34, a portion 36 of intermediate diameter, a second tapered portion 38, and then an elongated portion 39 of narrower diameter. In contrast, as shown in FIGS. 3 and 8, a live round 40 comprises an enlarged cartridge portion 42, a tapered portion 44, a portion 46 of intermediate diameter, and a bullet 47.

Figure 8:
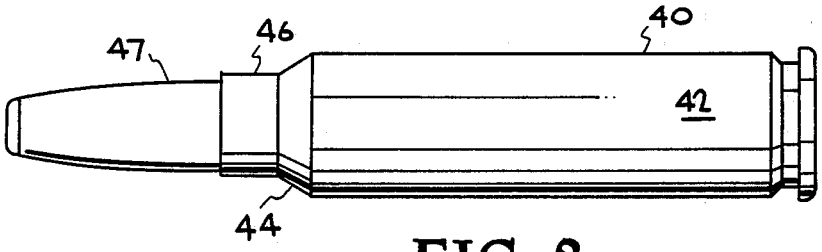
FIG. 8 is a side view of a live round suitable for insertion into a firearm of the type shown in FIGS. 1–5 when the live round inhibiting means of the invention is not installed therein.

Generally, as shown in the comparison between FIGS. 7 and 8, the length of both rounds, in this embodiment, are approximately equal, with the length of bullet 47 of live round 40 approximating the combined length of second tapered portion 38 and reduced diameter portion 39 of blank round 30.

In accordance with the invention, a live round inhibiting means 50 is mounted in barrel 4 by drilling a side bore 52 perpendicular to main bore 18 in barrel 4 of firearm 2. Bore 52 is formed at a point longitudinally along barrel 4 just beyond the point where second tapered portion 38 of blank cartridge 30 rests in barrel 4 when cartridge 30 is fully seated in chamber 14. To facilitate drilling of bore 52 and installation of live round inhibiting means 50, a flat portion 54 may first be machined on the outside surface of barrel 4 to break the surface hardness as well as to provide a flat seat. If necessary, as shown in FIGS. 1–5, a portion of flange 12 may also be cut away at 56 to permit proper location of bore 52 along the length of barrel 4.

After forming bore 52, the bore is at least partially threaded and live round inhibiting means 50, comprising shaft means which, in the illustrated embodiment, comprises threaded shaft means such as a threaded cap screw, is inserted into bore 52. In the illustrated embodiment, threaded capscrew 50 may comprise an 8-32UNC by 0.625" long heat treated alloy steel machine screw which is torqued to from about 5 to about 10 inch pounds to provide a gas tight seal in barrel 4.

Figure 6:
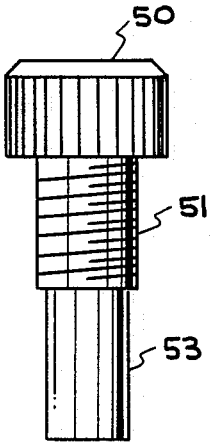
FIG. 6 is a side view of a portion of the live round inhibiting means of the invention.

As shown in FIG. 6, capscrew 50 may be provided with a threaded upper portion 51 and a smooth portion 53 of reduced diameter so that contact between the smooth portion 53 of live round inhibiting means 50 will not result in damage to the threaded portion 51 of capscrew 50 which comprises the live round inhibiting means.

As best seen in FIGS. 2 and 3, live round inhibiting means 50 is sized in length sufficiently to protrude beyond the wall of barrel 4 into bore 18 a sufficient distance to contact bullet portion 47 of live round 40 to thereby interfere with the insertion of live round 40 fully into chamber 14.

However, the extent of the protrusion of the end of live round inhibiting means 50 into bore 18 is limited to be slightly less than the difference between the radius of bore 18 and the radius of elongated narrow portion 39 of blank round 30 so that blank round 30, as shown in FIG. 2, may be chambered in firearm 2 without interference from live round inhibiting means 50.

The extent of the protrusion of live round inhibiting means 50 into bore 18 will usually range from about 0.020 to about 0.060" to thereby block chambering of live round 40 into firearm 2 while not interfering with the chambering of a blank round 30 into firearm 2. For example, for a firearm having a gun barrel bore of 0.300" and a blank having an elongated portion 39 having a diameter of 0.250", leaving a clearance of about 0.025" on each side of elongated portion 39 of the blank, the protrusion of live round inhibiting means 50 into bore 18 would typically range from about 0.020" to just under 0.025" to permit chambering of blank round 30.

Thus firearm 2 may be modified by the insertion of live round inhibiting means 50 into barrel 4 to prevent the accidental chambering and subsequent discharge of a live round while not interfering with the loading and firing of blank rounds in firearm 2, thereby rendering firearm 2 into a safe training weapon. It should be noted in this regard, that in an emergency, firearm 2 could then be modified to fire live rounds by the removal of live round inhibiting means 50 and replacement of same with a shorter means which would serve to block the passage of gas through bore 52 without interfering with the chambering of a live round therein. For safety reasons, such a modification would not be recommended except in a time of emergency.

Figure 9:
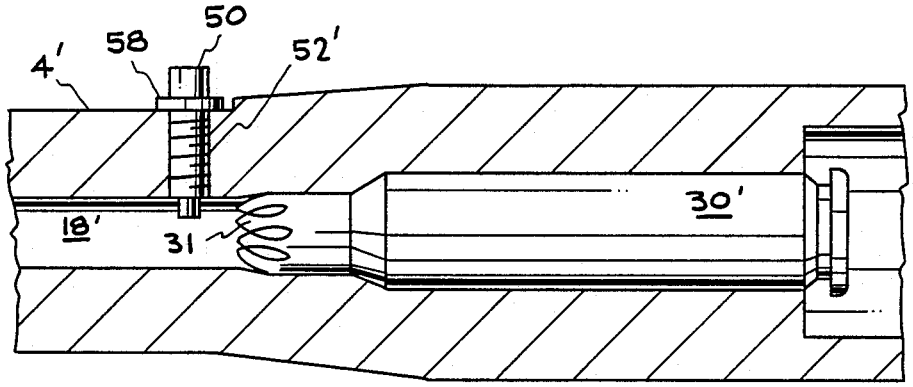
FIG. 9 is a fragmentary side section view of another embodiment of the invention wherein a firearm has been modified by a live round inhibiting means which will accept a blank cartridge of equal length to the cartridge portion of a live round while blocking the full insertion of a live round into the firearm.

Turning now to FIG. 9, another embodiment of the invention is shown which, for example, would be suitable for use with the M16 rifle. In this embodiment, a blank round 30' would not be provided with the tapered portion 38 and elongated narrow diameter portion 39 of blank round 30. Instead, blank round 30' might represent a cartridge of the same length as used for a live round, but with the end of the cartridge crimped off at 31. Blank round 30' would then be shorter than a live round by the length of the bullet which would otherwise be inserted into the cartridge.

In this embodiment, the length of live round inhibiting means 50, i.e., the extent of protrusion into bore 18', is not as crucial as long as the protrusion is sufficient to interfere with the bullet portion of a live round. As in the previous embodiment, a threaded bore 52' is provided in barrel 4' and a live round inhibiting means 50 is inserted into bore 52' to protrude into central bore 18'. In this embodiment, a washer 58 is shown mounted under the head of a capscrew comprising live round inhibiting means 50. Such a washer 58 could, of course, be used with either embodiment of the invention.

As in the earlier embodiment, the longitudinal position of bore 52' in barrel 4' and live round inhibiting means 50 therein is selected to place the protrusion of live round inhibiting means 50 into bore 18' of barrel 4' at a point where the bullet portion of a live round would be seated when the live round was properly chambered in the firearm. Thus, insertion of the crimped end-blank round 30' would not result in contact with live round inhibiting means 50, as shown in FIG. 9, while chambering of a live round would not be possible.

Thus, in either embodiment of the invention, a standard firearm can be modified in a manner which will still permit the firing of bank rounds while not permitting a live round to be properly chambered and fired due to the presence of the live round inhibiting means in the barrel of the firearm. Personnel may, therefore, be trained and familiarized with a firearm otherwise identical in function with a standard firearm capable of firing live ammunition without compromise of safety and fear of accidental discharge of a live round therein.

While a specific embodiment of the improvement in a firearm comprising a live round inhibiting means installed therein has been illustrated and a method described for carrying out the improvement in accordance with this invention, modifications and changes of the apparatus, parameters, materials, etc. will become apparent to those skilled in the art, and it is intended to cover in the appended claims all such modifications and changes which come within the scope of the invention.

What is claimed is:

1. A firearm equipped with live round inhibiting means mounted in a barrel of said firearm comprising shaft means in said barrel which engage the bullet portion of a live round to prevent it from properly chambering while not interfering with the loading of a blank round into said firearm.

2. The firearm of claim 1 wherein said shaft means in said barrel are located in a side bore in said barrel which is approximately perpendicular to the main bore in said firearm barrel.

3. The firearm of claim 2 wherein said side bore in said barrel is located at a point just beyond the chamber portion of said firearm to engage the bullet portion of a live round to prevent it from properly chambering while permitting a blank round, having the same total length as said live round, including an extended portion of smaller diameter than said bullet portion, to be loaded into the firearm and fired without engaging said shaft means, said shaft means extending into said bore a distance less than the difference between the radius of said bore and the radius of said extended portion of said blank round.

4. The firearm of claim 2 wherein said side bore in said barrel is located at a point just beyond the chamber portion of the firearm to engage the bullet portion of a live round to prevent it from properly chambering while permitting a blank round of equal length to the cartridge portion of the live round to be loaded into the firearm and fired.

5. The firearm of claim 2 wherein said live round inhibiting means comprise threaded shaft means and said side bore is at least partially threaded.

6. The firearm of claim 5 wherein said threaded shaft means is inserted into said threaded bore in said barrel a distance sufficient to engage the bullet portion of a live round while permitting a blank round to be loaded into said firearm and fired.

7. The firearm of claim 6 wherein said threaded shaft means comprise a machine screw inserted into said threaded bore in said barrel and tightened to from about 5 to about 10 inch pounds to provide a gas tight seal in said barrel.

8. The firearm of claim 5 wherein said threaded shaft means is inserted into said threaded bore in said barrel a distance sufficient to protrude into said main bore in said barrel a distance of from about 0.020" to about 0.060" to thereby block chambering of a live round into said firearm while not interfering with the chambering of a blank round into said firearm.

9. A firearm equipped with live round inhibiting means mounted in a threaded side bore in a barrel of said firearm comprising a threaded shaft member which protrudes from said side bore into the main bore in said barrel of said firearm a distance sufficient to prevent chambering of a live round in said firearm while permitting a blank round of ammunition to be loaded into said firearm and fired.

10. A firearm equipped with live round inhibiting means mounted in a barrel of said firearm to engage the bullet portion of a live round to prevent the loading and firing of said live round while permitting a blank round of ammunition to be loaded into said firearm and fired.

11. A method of forming a firearm with live round inhibiting means which comprises:

(a) forming a side bore in the barrel of said firearm to intersect the main bore in said barrel; and (b) inserting shaft means into said side bore a sufficient distance to protrude into said main bore in said barrel to prevent chambering of a live round in said firearm while permitting a blank round to be inserted and fired in said firearm.

12. The method of claim 11 wherein said step of inserting shaft means into said side bore to protrude into said main bore further comprises inserting said shaft means into said side bore a distance sufficient to permit said shaft means to protrude into said main bore a distance of from about 0.020" to about 0.060".

13. The method of claim 11 wherein said firearm is capable of firing a special blank round having a reduced diameter cartridge portion which extends from the normal portion of the cartridge a distance approximately equal to the length of a bullet located in a live round and said step of inserting shaft means into said side bore to protrude into said main bore further comprises inserting said shaft means into said side bore a distance equal to less than the difference between the radius of said main bore and the radius of said reduced diameter portion of said blank round.

14. The method of claim 11 including the further step of threading said side bore and wherein said step of inserting said shaft means into said side bore further comprises threading a threaded shaft member into said threaded side bore.

15. The method of claim 14 including the step of tightening said threaded shaft member in said threaded side bore to from about 5 to about 10 inch pounds to provide a gas tight seal in said barrel.

16. The method of claim 11 including the further step of forming a flat portion on the outer surface of said barrel of said firearm at the point where said side bore will be formed in said barrel.

* * * * *